United States Patent [19]

Hilty

[11] Patent Number: 4,658,999

[45] Date of Patent: Apr. 21, 1987

[54] SKI CARRIER

[75] Inventor: Andreas Hilty, Uznach, Switzerland

[73] Assignee: Ing. A. Hilty, Uznach, Switzerland

[21] Appl. No.: 750,748

[22] Filed: Jun. 28, 1985

[30] Foreign Application Priority Data

Aug. 6, 1984 [CH] Switzerland ..... 03765/84

[51] Int. Cl.[4] ..... A45F 3/02

[52] U.S. Cl. ..... 224/202; 224/257; 224/150; 224/917

[58] Field of Search ..... 242/85; 150/108; 190/115; 224/150, 917, 202, 257

[56] References Cited

U.S. PATENT DOCUMENTS

| | | | |
|---|---|---|---|
| 2,118,875 | 5/1938 | Windheim | 224/917 |
| 2,614,355 | 10/1952 | Rogers | 224/150 |
| 2,769,475 | 11/1956 | Fisher | 150/108 |

FOREIGN PATENT DOCUMENTS 3128920 10/1983 Fed. Rep. of Germany .

*Primary Examiner*—Stephen Marcus
*Assistant Examiner*—David Voorhees
*Attorney, Agent, or Firm*—Peter K. Kontler; Tobias Lewenstein

[57] ABSTRACT

A carrier for suspending a pair of skis from a shoulder has an elongated, flexible carrying strap which is designed to be attached to the skis forward and rearward of the ski bindings. One end of the strap is connected with a sheath for receiving the trailing ends of the skis. The sheath carries a band which serves to attach the sheath to the skis and to bind the trailing ends of the skis to one another. The other end of the carrying strap is connected with a coiling device which is designed to be clamped between the skis forward of the ski bindings. The coiling device again carries a band for attaching the skis to the coiling device and binding the leading portions of the skis to one another. The coiling device is receivable by the sheath. When the skis are to be used, the sheath and the coiling device are detached therefrom. The carrying strap is then wound onto the coiling device, and the latter is subsequently inserted into the sheath. The ski carrier is thus converted into a compact unit which may be readily stored in the pocket of a ski outfit.

20 Claims, 3 Drawing Figures

16''
18
21
11
12
13
20
16'
17'
27
16
17
10
9
2

III
6
15
25
14
24
23
27
11
12
21
10
III
4
5
2
7
33
31
35
30
2
5
6
12
3
8
4
7
33

SKI CARRIER

BACKGROUND OF THE INVENTION

The invention relates generally to a carrier for a pair of skis.

More particularly, the invention relates to a ski carrier in the form of a strap which is attached to longitudinally spaced locations of a pair of superimposed skis to be transported. Such a strap is preferably attached to the skis forward and rearward of the ski bindings.

Ski carriers consisting of a carrying strap and two fastening elements for attaching the strap to the skis are known in various forms. The fastening elements may consist of bands or loops, and one of the fastening elements normally engages the skis forward of the ski bindings while the other normally engages the skis rearward of the bindings. The carrying strap is designed in such a manner that the skis may be suspended from a shoulder of a person carrying the skis.

The known ski carriers have the drawbacks of being cumbersome when detached from the skis and of taking up much space when stored in ski clothing. Therefore, these ski carriers are seldom or never used. The skis are thus carried on a shoulder or under an arm while walking, e.g., to a ski lift or an alpine railway. These methods of carrying the skis are not only uncomfortable but also dangerous, especially when walking along icy streets and paths while wearing ski boots made of synthetic resin. Neither hand, or at most one hand, is available to break a fall when carrying the skis on a shoulder or under an arm so that injuries can easily occur. Furthermore, such methods of carrying the skis pose an extreme danger in the usually crowded railway and ski lift stations due to the possibility of head injuries to fellow passengers.

OBJECTS AND SUMMARY OF THE INVENTION

It is an object of the invention to provide a ski carrier which makes it possible to carry skis with relative safety.

Another object of the invention is to provide a ski carrier which enables skis to be carried with relative comfort.

An additional object of the invention is to provide a ski carrier which, upon detachment from the skis, can be carried in such a way as not to interfere significantly with skiing.

A further object of the invention is to provide a ski carrier which is capable of being readily stored in a pocket.

It is also an object of the invention to provide a ski carrier which may remain attached to the skis with little, if any, adverse effects during other than manual means of transport, e.g., when the skis are transported on the roof of an automobile or by train.

The preceding objects, as well as others which will become apparent as the description proceeds, are achieved by the invention.

One aspect of the invention resides in a carrier for a pair of skis which comprises the following:

A. An elongated, flexible carrying element designed to be connected with longitudinally spaced first and second locations of the skis. Preferably, the carrying element is designed to be attached to the skis forward and rearward of the ski bindings. The carrying element has a length sufficient to suspend the skis from a shoulder of a person carrying the same.

B. A coiling device connected with the carrying element.

The ski carrier of the invention makes it possible to suspend the skis from the shoulder in different ways depending upon the circumstances so that both hands are free for other purposes. For example, the carrying element may pass under an arm and to the shoulder on the same side of the body, and the skis may be located to either the back or the front of the person carrying the skis. On the other hand, the carrying element may pass under an arm and to the shoulder on the other side of the body. Furthermore, the ski carrier may be designed so that the skis have a generally vertical orientation when suspended from the shoulder. This reduces the likelihood of head injuries to fellow passengers by the ski tips or ends. The ski carrier according to the invention has the additional advantage that it may remain attached to the skis when not in use or, alternatively, may be detached and readily stored in a pocket of a ski outfit. Moreover, the ski carrier may be designed in such a manner that the edges of the skis contact the shoulder. This has the significant advantage of reducing interference by the bulky ski bindings in use today.

The carrying element has a coiled configuration which it may assume when the ski carrier is not in use, and an extended configuration which is assumed preparatory to and during transport of the skis on the shoulder. It is possible, for example, to provide the coiling device with a small crank in order to wind the carrying element from the extended configuration into the coiled configuration. However, in accordance with a particularly advantageous embodiment of the invention, the coiling device includes a biasing element such as a spring for urging the carrying element into the coiled configuration. The carrying element may then be wound onto the coiling device automatically.

The carrying element may be provided with a pair of fastening elements, e.g., bands, for attaching the carrying element to the skis and holding the latter together so that they do not slip relative to one another. This makes it unnecessary to supply separate fastening elements in order to hold the skis together. The carrying element is preferably designed for attachment to the skis forward and rearward of the ski bindings.

The coiling device may include a reel which is fast with the carrying element, and a housing which accommodates the reel. The housing may, for example, be secured to the upper surface of one of the skis. It is also possible to install the housing in one of the ski slats or one of the bindings. However, in accordance with a preferred embodiment of the invention, the housing is separate from the ski slats and bindings.

The coiling device may be formed as a unit with one of the fastening elements. The other fastening element may be permanently or, alternatively, may be designed to be releasably, connected with one of the skis. If the latter fastening element forms a permanent connection with one of the skis, the carrying element may be provided with a device for releasably connecting the same with such fastening element.

According to an advantageous embodiment of the invention, both of the fastening elements are provided on the carrying element, and the housing of the coiling device is integrated into a unit with one of the fastening elements. The coiling device is separate from the skis, and the housing is designed to be clamped between the running surfaces of the skis. The carrying element is adapted to be attached to the skis forward and rearward of the bindings with the arrangement advantageously being such that the coiling device is located forward of the bindings.

The housing may be formed with a pair of flanges which are disposed on opposite sides of the housing and are arranged to abut the edges of the skis when the housing is placed between the running surfaces of the skis. This helps to inhibit sliding of the skis transverse to their longitudinal axes and to reduce the stress on the fastening element which is mounted on the housing. This fastening element may be in the form of a band.

As mentioned earlier, the coiling device advantageously includes a biasing element for urging the carrying element into a coiled condition. This biasing element may act on the reel which is secured to the carrying element. The coiling device may further include an arresting mechanism for arresting the biasing element or reel. The arresting mechanism may comprise a button for releasing the biasing element or reel, and such button may be mounted anywhere on the housing of the coiling device. The button has a first position in which the biasing element or reel is locked, and a second position in which the biasing element or reel is released. In a particularly favorable embodiment of the invention, the button is situated on a side of the housing which abuts the running surface of a ski when the housing is clamped between the skis. The button is then arranged to move from the first position to the second position in response to clamping of the housing between the skis so that the biasing element or reel is released automatically upon such clamping. By way of example, the button may be a pushbutton which projects beyond the respective side of the housing in the first position and is depressed to the second position when the housing is clamped between the skis.

The fastening element which is not integrated with the coiling device may include a sheath which is capable of receiving the trailing ends of the skis, and a band for clamping the skis to one another. The sheath is preferably in the form of an angle member having a pair of side walls. Such a fastening element makes it possible to secure the skis to the end of the carrying element remote from the coiling device in such a manner as to prevent sliding of the skis relative to one another.

The sheath may be provided with slits for the purpose of attaching the carrying element thereto. These slits, which are preferably parallel to each other, enable the length of the carrying element to be adjusted to the length of the skis in a simple and economical manner.

The sheath is advantageously designed so as to be capable of receiving the housing of the coiling device once the sheath has been removed from the ends of the skis. This permits the size of the ski carrier to be reduced and facilitates storage of the carrier in a pocket.

The reel of the coiling device may include a take-up element rotatably mounted on a shaft carried by the housing of the coiling device, and the biasing element for urging the carrying element into its coiled condition may be in the form of a coil spring which bears against the reel and the shaft. With this arrangement, tensile forces generated in the carrying element when this is fully extended are transmitted to the biasing element and the shaft and can damage the same. In order to prevent damage to the biasing element and the shaft while keeping the housing easy to handle and relatively small, the carrying element may be provided with an enlargement, and the housing formed with an abutment in the region of the opening for the carrying element. The enlargement and abutment are arranged to engage one another in the extended configuration of the carrying element so that tensile forces in the latter are transmitted into the housing via the abutment.

According to a further embodiment of the invention, the sheath, as well as the housing of the coiling device, are injection molded from thermoplastic material.

The ski carrier is advantageously designed in such a manner that the outer dimensions thereof do not exceed 66 mm×74 mm×32 mm when the housing of the coiling device is confined in the sheath. This facilitates handling of the skis when the carrier is attached to the same and also improves storage of the ski carrier in the pocket of a ski outfit.

The novel features which are considered as characteristic of the invention are set forth in particular in the appended claims. The improved ski carrier, itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figures 1, 2, 3:
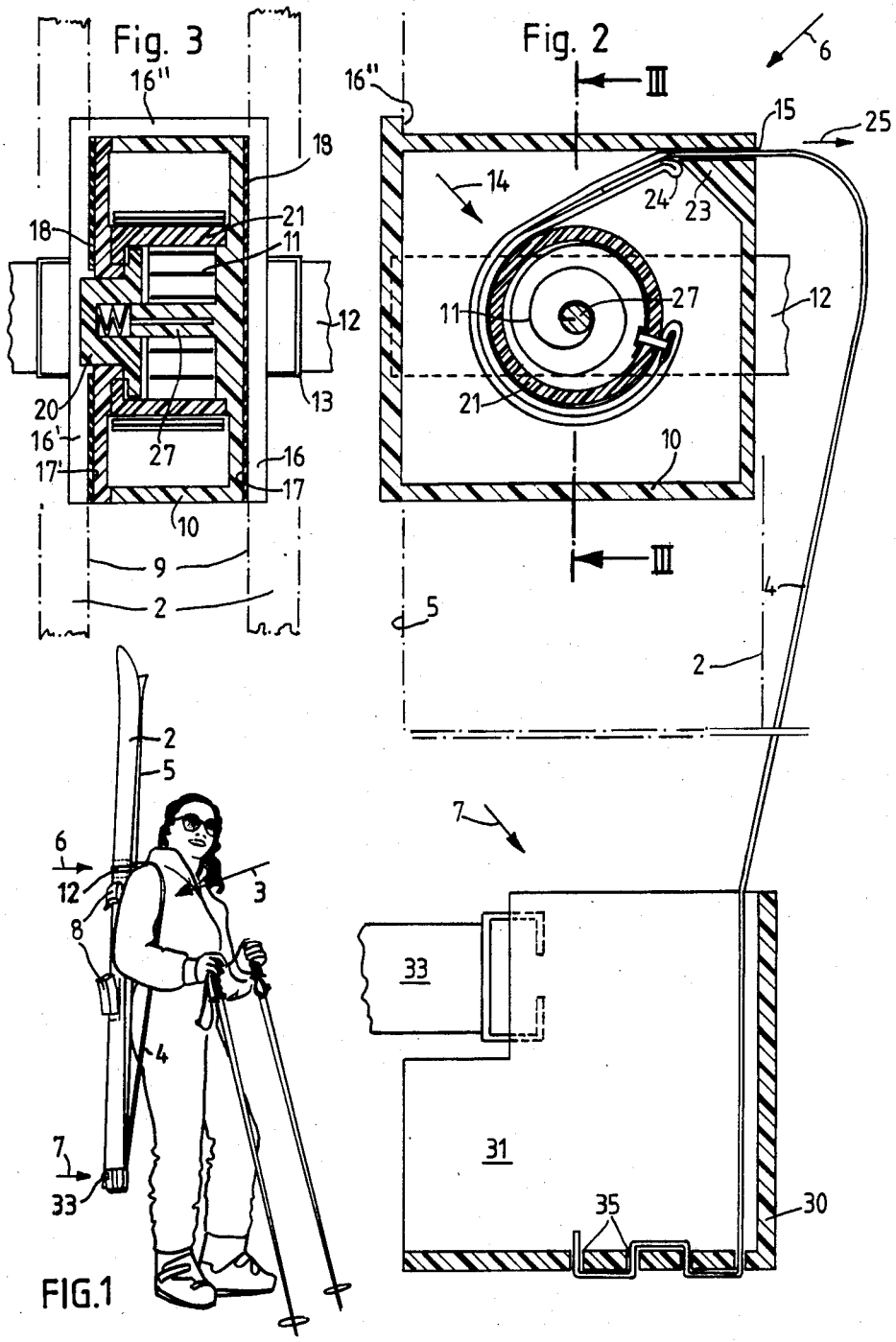
FIG. 1 shows a pair of skis held together by a ski carrier according to the invention.
FIG. 2 is a transverse sectional view of the ski carrier of FIG. 1.
FIG. 3 is a sectional view in the direction of the arrows III—III of FIG. 2.

Referring to FIG. 1, the reference numeral 2 identifies a ski. The ski 2 is superimposed with a second ski 2 which is only partially visible in FIG. 1, and the skis 2 are attached to and held together by a ski carrier 3. The ski carrier 3 includes an elongated, flexible carrying element 4 which will be referred to as a carrying strap throughout the description, as well as a fastening and coiling unit 6 and a fastening element 7. Each of the skis 2 has a binding 8 for a ski boot, and the unit 6 is located forward of the bindings 8 while the fastening element 7 is located rearward of the bindings 8.

As shown in FIG. 2, the fastening and coiling unit 6 comprises a reel 14 which is connected with one end of the carrying strap 4. The latter has a coiled configuration in which a portion of the same is wound onto the reel 14, and an extended configuration in which this portion of the carrying strap 4 is payed out from the reel 14. FIGS. 1 and 2 illustrate the extended configuration of the carrying strap 4. The ski carrier 3 is designed to permit the skis 2 to be suspended from the shoulder of a person, at least in the extended condition of the carrying strap 4, and the length of the latter is selected accordingly. The length of the carrying strap 4 may be such that it can pass under an arm and to the shoulder on the same side of the body or to the shoulder on the other side of the body. The skis 2 may be suspended to either the back or the front of the person carrying the skis 2 when using the ski carrier 3. The ski carrier 3 is further designed in such a manner that the edges 5 of the skis 2 confront or contact the shoulder of the person carrying the skis 2.

The reel 14 is advantageously accommodated in a housing or case 10 as illustrated in FIGS. 2 and 3. The reel 14 includes a rotary take-up element 21, as well as a shaft 27 which is carried by the housing 10 and supports the take-up element 21 for rotation. A biasing element, e.g., in the form of a coil spring 11, is interposed between and bears against the take-up element 21 and the shaft 27. The coil spring 11 urges the take-up element 21 in a direction to wind the carrying strap 4 onto the take-up element 21, i.e., in a counterclockwise direction as viewed in FIG. 2.

The housing 10; the take-up element 21; the shaft 27; the spring 11; and an arresting element 20 to be described below together constitute a coiling device for winding up and unwinding the carrying strap 4.

The coiling device 10,11,20,21,27 is designed to be clamped between the skis 2. In order to hold the coiling device 10,11,20,21,27 between the skis 2, the fastening and coiling unit 6 is provided with a fastening element in the form of a band 12. The band 12 is arranged to pass around the skis 2 and the coiling device 10,11,20,21,27 to thereby urge the skis 2 against the housing 10. The band 12 has closure means to prevent it from opening, and such closure means may be in the form of hooks, Velcro TM, etc. The band 12 is mounted on the housing 10, and a steel clip 13 may be employed for this purpose.

As best seen in FIG. 3, the housing 10 has a pair of opposite surfaces 17,17' which are arranged to abut the running surfaces 9 of the skis 2 when the coiling device 10,11,20,21,27 is clamped between the skis 2. The surfaces 17,17' of the housing 10 may be provided with a friction layer 18 such as, for example, a thin coating of rubber.

The housing 10 has an opening 15 for the carrying strap 4. The side of the housing 10 opposite the opening 15 is formed with flanges 16,16' which are arranged to abut the edges 5 of the skis 2 when the coiling device 10,11,20,21,27 is held between the skis 2. The flanges 16,16' extend along the opposite surfaces 17, 17' of the housing 10. The side of the housing 10 remote from the opening 15 may further be provided with flanges along those surfaces which bridge the surfaces 17,17'. This is illustrated by the flange 16''.

As shown in FIG. 3, the arresting element 20 of the coiling device 10,11,20,21,27 comprises a pushbutton which is movable between a raised, operative position and a depressed, inoperative position. In the operative position, the pushbutton functions to arrest the take-up element 21, and hence the coil spring 11, so that the take-up element 21 is unable to rotate in a direction to wind up the carrying strap 4, i.e., in a counterclockwise direction as viewed in FIG. 2. However, the take-up element 21 is free to rotate in a direction to pay out the carrying strap 4. In the inoperative position of the pushbutton, the take-up element 21 is released and able to wind up or unwind the carrying strap 4. The pushbutton is continuously urged to its operative position by a compression spring which bears against the pushbutton as well as the shaft 27 of the coiling device 10,11,20,21,27.

In the operative position, the pushbutton projects beyond the surface 17' of the housing 10. Thus, when the coiling device 10,11,20,21,27 is clamped between the skis 2, the running surface 9 of the ski 2 adjacent to the surface 17' depresses the pushbutton to its inoperative position. The take-up element 21 and the coil spring 11 are accordingly released in automatic response to clamping of the coiling device 10,11,20,21,27 between the skis 2.

As illustrated in FIG. 2, an abutment 23 is formed internally of the housing 10 in the region of the opening 15. The end of the carrying strap 4 which is connected with the reel 14 is thicker than the remainder of the carrying strap 4 and includes an enlargement 24. The enlargement 24 is arranged to engage the abutment 23 in the extended configuration of the carrying strap 4. The abutment 23 and the enlargement 24 then create a lock with respect to the tensile forces which are generated in the carrying strap 4 in response to stresses applied in the direction of the arrow 25. The tensile forces set up in the carrying strap 4 when this is in its extended condition are thus conducted directly into the housing 10 via the abutment 23. This prevents the tensile forces in the extended carrying strap 4 from acting upon the coil spring 11 and the shaft 27 so that damage to the coil spring 11 and the shaft 27 is avoided.

Referring still to FIG. 2, the fastening element 7 connected with the end of the carrying strap 4 remote from the coiling device 10,11,20,21,27 comprises a sheath which is designed to receive the trailing ends of the skis 2. The sheath is composed of an angle member 30 having a pair of opposed side walls 31 of which only one is visible. A band 33 which may be made of rubber, for example, is mounted on the sheath 30,31. The band 33 functions to attach the sheath 30,31 to the skis 2 and to bind the trailing ends of the skis 2 to one another. The band 33 may be secured to the sheath 30,31 in any suitable manner and may be provided with conventional closure means to prevent it from opening.

A series of parallel slits 35 is formed in the angle member 30. The slits 35 are designed so that the end of the carrying strap 4 remote from the coiling device 10,11,20,21,27 may be drawn through and held by the slits 35 thereby establishing a connection between the carrying strap 4 and the sheath 30,31. This or a similar mode of securing the carrying strap 4 to the sheath 30,31 makes it possible to optimally adjust the length of the carrying strap 4 in dependence upon the length of the skis 2 and the size of the person carrying the skis 2.

The sheath 30,31 is designed in such a manner that it may be slipped onto the housing 10 of the coiling device 10,11,20,21,27. The sheath 30,31 then requires little additional space when the ski carrier 3 is placed in a pocket for storage. The dimensions of the ski carrier 3 with the housing 10 accommodated in the sheath 30,31 preferably do not exceed 66 mm×74 mm×32 mm.

The housing 10 and the sheath 30,31 are advantageously injection molded from a thermoplastic material.

The fastening and coiling unit 6 and the fastening element 7 may be used for skis of any width including narrow cross-country skis.

In order to reduce the size of the housing 10, and hence of the ski carrier 3, the carrying strap 4 may be composed of a wider first section in the form of a band and a narrower second section in the form of a cord or a string. The wider section of the carrying strap 4 then makes up only that portion of the latter which lies in the shoulder region bearing the weight of the skis 2. The purpose is to reduce discomfort to the person carrying the skis 2.

When the skis 2 are to be used, the unit 6 and the fastening element 7 are detached therefrom. The carrying strap 4 is then wound onto the reel 14 under the action of the coil spring 11. Subsequently, the housing 10 of the coiling device 10,11,20,21,27 is inserted in the sheath 30,31 to form a compact unit which may be readily stored in the pocket of a ski outfit.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A carrier for a pair of skis each of which has a leading end, a trailing end and a binding between the leading and trailing ends, comprising an elongated, flexible carrying element designed to be connected with longitudinally spaced first and second locations of the skis forward and rearward of the bindings, said carrying element having a length sufficient to suspend the skis from a shoulder, and said carrying element having an extended configuration for suspension of the skis, and a coiled configuration; a coiling device connected with said carrying element for winding the latter into said coiled configuration, said coiling device including a reel, and a housing for said reel; and first and second fastening means connected with said carrying element and designed to relasably fasten the latter to the first and second locations of the skis, said coiling device and one of said fastening means being integrated into a unit, and said one fastening means including a band arranged to fasten said housing to the skis and being designed to clamp said housing between the running surfaces of the skis, the other of said fastening means comprising a sheath designed to receive the trailing ends of the skis and said sheath being further designed to receive said housing.

2. The carrier of claim 1 wherein said coiling device comprises a biasing element for urging said carrying element into said coiled configuration.

3. The carrier of claim 2, wherein said biasing element comprises a spring.

4. The carrier of claim 1, wherein said housing has a pair of opposite sides, and a flange at each of said sides, said flanges being designed to abut the edges of the respective skis.

5. The carrier of claim 1, wherein said carrying element and said fastening means are designed for clamping of said housing at a location forward of the bindings.

6. The carrier of claim 1, wherein said coiling device comprises a biasing element for urging said carrying element into said coiled configuration, and arresting means for releasably arresting said biasing element.

7. The carrier of claim 6, said housing having a side arranged to abut the running surface of a ski; and wherein said arresting means comprises a pushbutton having a raised position in which said biasing element is arrested, and a depressed position in which said biasing element is released, said pushbutton projecting from said side in said raised position and being movable to said depressed position in response to clamping of said housing between the running surfaces of the skis.

8. The carrier of claim 1, wherein said sheath includes an angle member, and a pair of side walls mounted on said angle member.

9. The carrier of claim 8, wherein said sheath is provided with a plurality of slits for securing said carrying element thereto.

10. The carrier of claim 9, wherein said slits are formed in said angle member.

11. The carrier of claim 10, wherein said slits are substantially parallel to one another.

12. The carrier of claim 1, said housing being inserted in said sheath for storage to form a compact unit; and wherein the outer dimensions of said unit are at most about 66 mm×74 mm×30 mm.

13. The carrier of claim 1, wherein said sheath is composed of a thermoplastic material.

14. The carrier of claim 13, wherein said sheath is injection molded.

15. The carrier of claim 1, wherein said housing is composed of a thermoplastic material.

16. The carrier of claim 15, wherein said housing is injection molded.

17. The carrier of claim 1, wherein; said housing has an opening for said carrying element and is provided with an abutment in the region of said opening, said carrying element having an enlargement which engages said abutment in said extended configuration so that tensile forces are transmitted from said carrying element to said housing via said abutment.

18. The carrier of claim 1, wherein said carrying element comprises a strap.

19. The carrier of claim 1, wherein said carrying element comprises a first section in the form of a strap, and a second section in the form of a cord.

20. The carrier of claim 1, wherein said housing has a pair of external surfaces each of which is arranged to abut one of the running surfaces, at least one of said external surfaces being provided with a friction layer.

* * * * *